US009743725B2

(12) United States Patent
Hines et al.

(10) Patent No.: US 9,743,725 B2
(45) Date of Patent: Aug. 29, 2017

(54) CLASPS HAVING A RELEASE BUTTON AND JEWELRY ARTICLES EMPLOYING SAME

(71) Applicant: Chamilia, LLC, Cranston, RI (US)

(72) Inventors: Troy Hines, New Bedford, MA (US); Declan Halpin, New Bedford, MA (US); Haowen Chen, Panyu Guangzhou (CN); Yongqiang Zhang, Panyu Guangzhou (CN)

(73) Assignee: Chamilia, LLC, Cranston, RI (US)

( * ) Notice: Subject to any disclaimer, the term of this patent is extended or adjusted under 35 U.S.C. 154(b) by 238 days.

(21) Appl. No.: 14/524,676

(22) Filed: Oct. 27, 2014

(65) Prior Publication Data

US 2016/0113360 A1 Apr. 28, 2016

(51) Int. Cl.
*A44C 5/20* (2006.01)

(52) U.S. Cl.
CPC ..... *A44C 5/2052* (2013.01)

(58) Field of Classification Search
CPC ... A44C 5/2052; A44C 5/0084; A44C 5/0092; A44C 5/12; A44C 5/0061; A44C 7/00; A44C 7/002; A44C 9/0038; A44C 9/0046; A44B 11/2507; A44B 11/5211; A44B 11/2515
USPC ..... 24/652, 653, 656, 662, 664, 647, 591.1, 24/593.1, 595.1, 629, 633, 643, 657, 658, 24/700, 701; 63/3.1
See application file for complete search history.

(56) References Cited

U.S. PATENT DOCUMENTS 4,310,953 A * 1/1982 Nanasi ..... A44C 5/2052 24/656
4,924,562 A 5/1990 Pogharian
D314,929 S 2/1991 Chia et al.
(Continued)

FOREIGN PATENT DOCUMENTS

CH 676073 12/1990
CH 686280 A5 * 2/1996 ..... A44C 5/0092
(Continued)

OTHER PUBLICATIONS

International Search Report and Written Opinion received from the International Searching Authority of the International Application No. PCT/US2015/057522 (along with PCT/US2015/057522 application and drawings), 53-pages, dated Feb. 9, 2016.
(Continued)

*Primary Examiner* — Abigail Troy
(74) *Attorney, Agent, or Firm* — Heslin Rothenberg Farley & Mesiti P.C.

(57) ABSTRACT

A clasp includes a male clasp portion having a tongue having an opening, and a female clasp portion having a generally hollow body. The hollow body has a first opening and a second opening. A movable button is disposed in the body, and the button has a first portion positioned in the second opening of the hollow body and a second portion defining a post. A biasing member is operable to bias the button in a locking position in which the post is disposable across at least a portion of the opening in the tongue when the tongue is disposed in the first opening of the hollow body, and the button is operable to being moved to a release position in which the post is disengagable from the opening in the tongue to allow the tongue to be spaced from the hollow body.

19 Claims, 18 Drawing Sheets

(56) References Cited

U.S. PATENT DOCUMENTS

| | | | | |
|---|---|---|---|---|
| 5,138,751 | A * | 8/1992 | Shima | A44B 11/2511 24/637 |
| 6,606,770 | B1 * | 8/2003 | Badrenas Buscart | A44B 11/2511 24/625 |
| 6,729,159 | B2 | 5/2004 | Rose | |
| D526,592 | S | 8/2006 | Crawford | |
| 7,350,376 | B2 | 4/2008 | Couling | |
| 7,353,665 | B2 | 4/2008 | Richardson | |
| 7,540,172 | B2 | 6/2009 | Julkowski et al. | |
| D632,204 | S | 2/2011 | Schmitz | |
| 7,878,024 | B2 * | 2/2011 | Baik | A44C 7/00 24/574.1 |

FOREIGN PATENT DOCUMENTS

| | | |
|---|---|---|
| KR | 101426023 | 7/2014 |
| WO | WO 0232249 | 4/2002 |

OTHER PUBLICATIONS

Hines et al., pending utility U.S. Appl. No. 29/507,376, filed Oct. 27, 2014, entitled "Jewelry Clasp".

Pandora Bangle, "Pandora Bangle Introduction and Review", printout available online at Charms Addict on Oct. 27, 2014, at http://www.charmsaddict.com/2013/04/pandora-bangle-introduction-and-review/, 3-pages, Apr. 7, 2013.

Chamilia Brilliance Bangle, "Chamilia Brilliance Bangle Review", printout available online at Charms Addict on Oct. 27, 2014, at http://www.charmsaddict.com/2014/02/chamilia-brilliance-bangle-review/, 3-pages, Feb. 28, 2014.

Chamilia Flex Bangle, "Chamilia Flex Bangle Review", printout available online at Charms Addict on Oct. 27, 2014, at http://www.charmsaddict.com/2013/11/chamilia-flex-bangle-review/, 3-pages, Nov. 22, 2013.

Chamilia Bangle Starter Bracelet in Sterling Silver, available from Day's Jewelers, printout available online on Oct. 27, 2014, at http://www.daysjewelers.com/bracelets-without-stones/chamilia-bangle-starter-bracelet-in-sterling-silver, 3-pages,, Dec. 6, 2013.

* cited by examiner

CLASPS HAVING A RELEASE BUTTON AND JEWELRY ARTICLES EMPLOYING SAME

CROSS-REFERENCE TO RELATED APPLICATIONS

This application is related to the subject matter of concurrently filed U.S. design patent application Ser. No. 29/507,376, by Hines et al., and entitled "Jewelry Clasp", the entire subject matter of which is incorporated herein by reference.

FIELD OF THE DISCLOSURE

The present disclosure relates to clasps for items of jewelry, and more specifically, to clasps having a button operated release and jewelry articles employing same

BACKGROUND

Jewelry such as small decorative items worn for personal adornment includes bracelets, necklaces, brooches, rings, and earrings. Typically, bracelets and necklaces include a clasp for maintaining the jewelry secured to a person.

There is a need for further clasps for items of jewelry, and more specifically, to clasps having a button operated release and jewelry articles employing same.

SUMMARY

In a first aspect, the present disclosure provides a clasp having a male clasp portion and a female clasp portion. The male clasp portion includes a tongue having an opening. The female clasp portion includes a generally hollow body having a first opening and a second opening. A movable button is disposed in the body, and the movable button has a first portion positioned in the second opening of the generally hollow body and a second portion defining a post. A biasing member is disposed between the movable button and the body. The biasing member is operable to bias the movable button in a locking position in which the post is disposable across at least a portion of the opening in the tongue when the tongue is disposed in the first opening of the generally hollow body, and the movable button is operable to being moved to a release position in which the post is disengagable from the opening in the tongue to allow the tongue to be spaced from the generally hollow body.

In a second aspect, the present disclosure provides a jewelry article which includes an elongated member having a first end portion and a second end portion, a male clasp portion, and a female clasp portion. The male clasp portion is attached to the first end portion of the elongated member. The male clasp portion includes a tongue having an opening. The female clasp portion includes a generally hollow body attached to the second end portion of the elongated member. The generally hollow body has a first opening and a second opening. A movable button is disposed in the body. The movable button has a first portion positioned in the second opening of the generally hollow body and a second portion defining a post. A biasing member is disposed between the movable button and the body. The biasing member is operable to bias the movable button in a locking position in which the post is disposable across at least a portion of the opening in the tongue when the tongue is disposed in the first opening of the generally hollow body, and the movable button being is operable to being moved to a release position in which the post is disengagable from the opening in the tongue to allow the tongue to be spaced from the generally hollow body.

In a third aspect, the present disclosure provides a method for securing and removing a jewelry article from a person. The method includes engaging a male clasp portion with a movable biased post of a female clasp portion to connect the male clasp portion to the female clasp portion to secure the jewelry article to the person, and moving the biased movable post of the female clasp portion to release the movable biased post from the male clasp portion to allow removing the jewelry article from the person.

Additional features and advantages are realized through the concepts of the present disclosure. Other embodiments and aspects of the disclosure are described in detail herein and are considered a part of the claims.

BRIEF DESCRIPTION OF THE DRAWINGS

Various aspects of the present disclosure are particularly pointed out and distinctly claimed as examples in the claims at the conclusion of the specification. The foregoing and other objects, features, and advantages of the disclosure are apparent from the following detailed description taken in conjunction with the accompanying drawings in which:

DETAILED DESCRIPTION

The present disclosure addresses and enhances, inter alia, attachment and detachment of jewelry articles such as bracelets and necklaces worn on a person. As explained in greater detail below, in one aspect the present disclosure is directed to a clasp having a button actuated movable post that is releasably engageable with a tongue having an opening. Such a clasp allows for a quick connection of the jewelry article to a person and a quick release or disconnect and removal of the jewelry article from the person. As also explained in greater detail below, in another aspect, the present disclosure is directed to a jewelry article such as a bracelet or a bangle with a generally rigid spring-like elongated member that aids a user in opening and closing the clasp.

Figure 1:
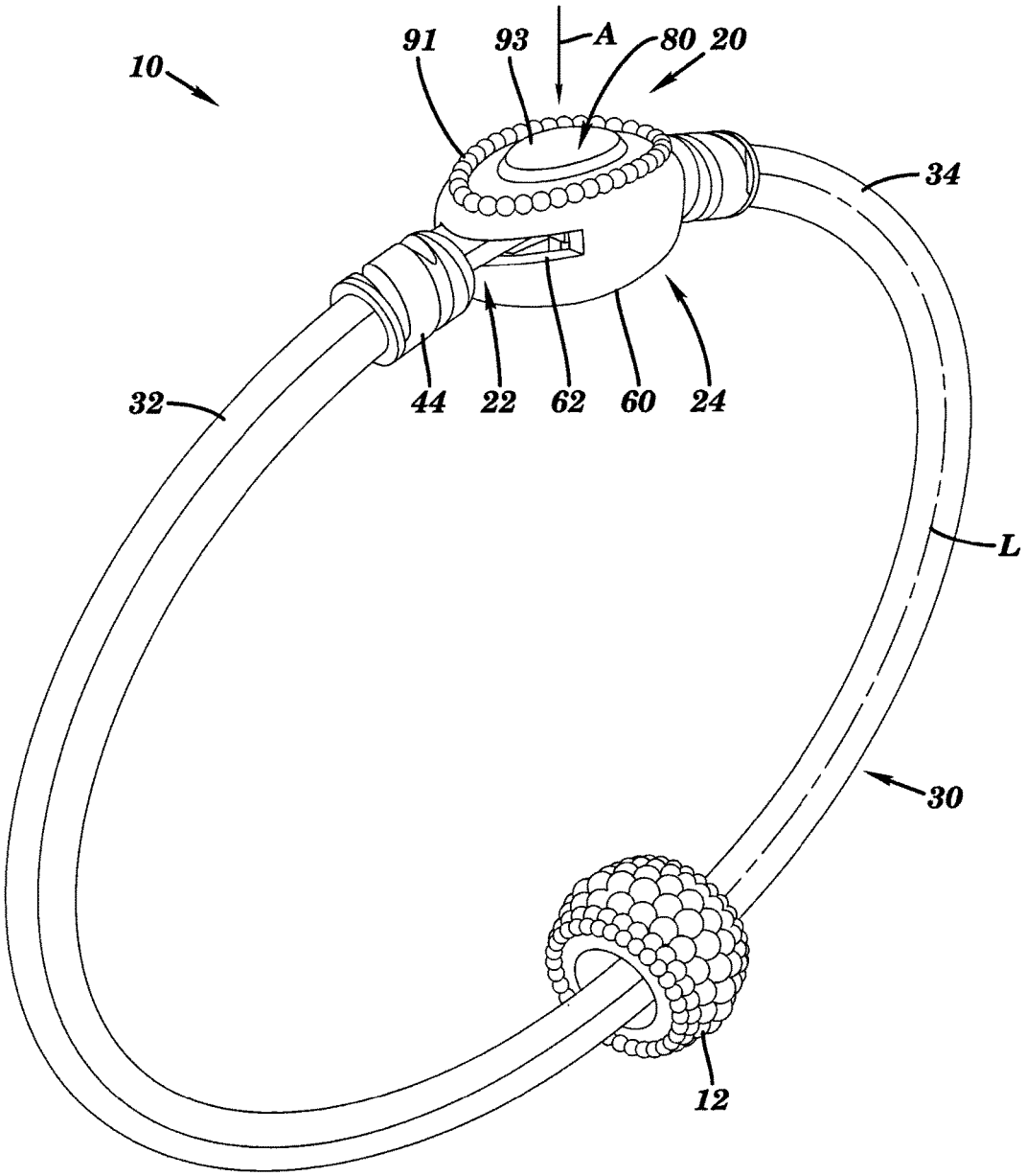
FIG. 1 is a perspective view of a jewelry article in accordance with aspects of the present disclosure.

FIG. 1 illustrates one embodiment of a jewelry article 10 such as a bracelet having a clasp 20 in accordance with one or more aspects of the present disclosure. Bracelet 10, as shown in FIG. 1, is illustrated in a closed position such as when worn on a wrist of a person. For example, clasp 20 may be employed to releasably attach a first end portion 32 of an elongated member 30 to a second end portion 34 of the elongated member. Elongated member 30 may support one or a plurality of decorative items 12. The elongated member may be fabricated from a suitable material or materials. For example, such materials may include, but not limited to, silver, gold, brass, and steel. The decorative items may include charms fabricated from a suitable material or materials. For example, the charms may be fabricated from silver or gold, jewels. The charms may be generally round or generally cylindrical in shape. The charms may be configured in non-recognizable or recognizable objects such as animals, symbols, letters, words, etc. Selection of a bracelet and charms may allow creations of a unique or custom piece of jewelry. While the present disclosure is in reference to bracelets, one or more aspects of the technique of the present disclose is applicable to anklets, armlets, necklaces, necklaces, and may or may not include a pendent and/or to other jewelry items.

Figure 2:
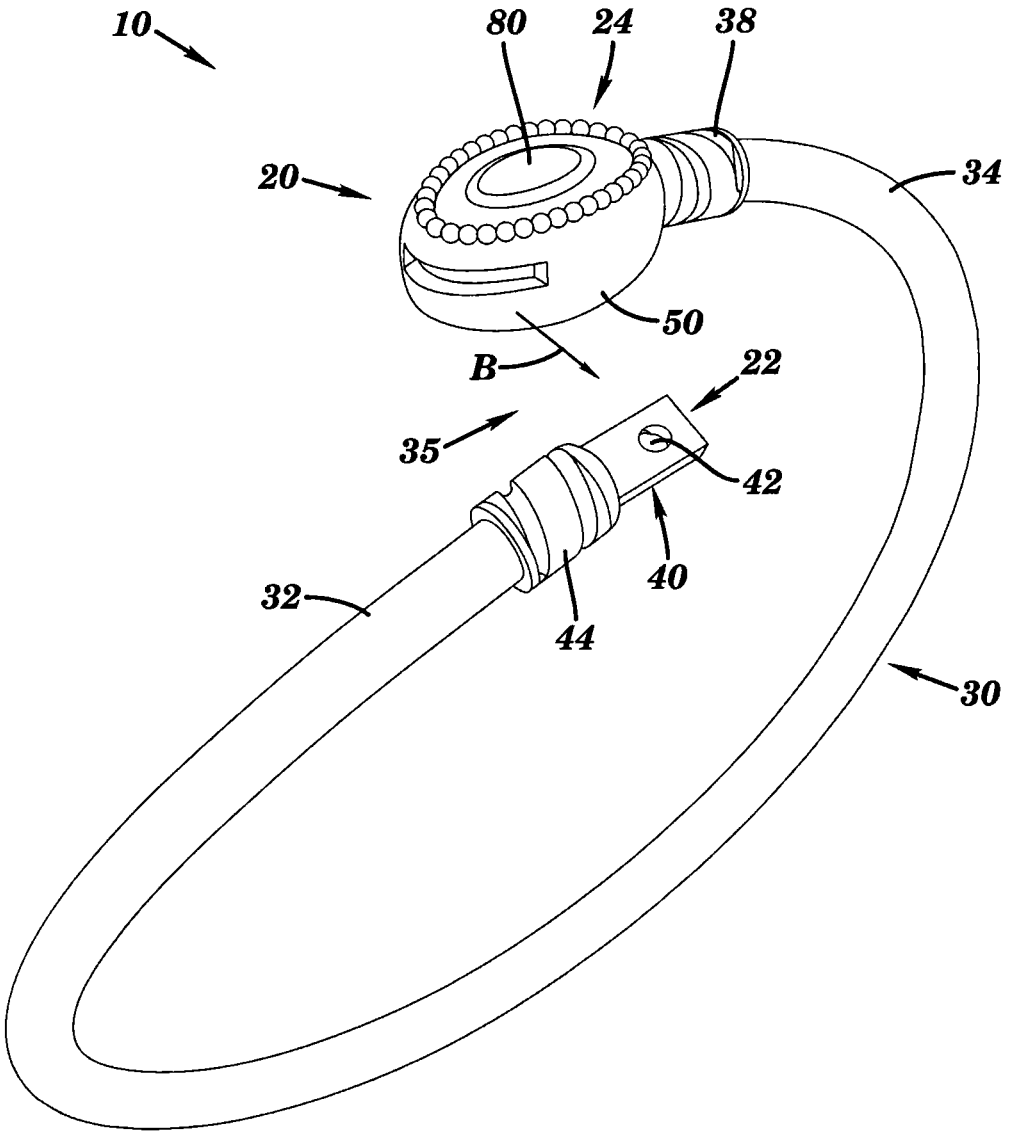
FIG. 2 is a perspective view of the jewelry article of FIG. 1 disposed in an open position.
Figure 3:
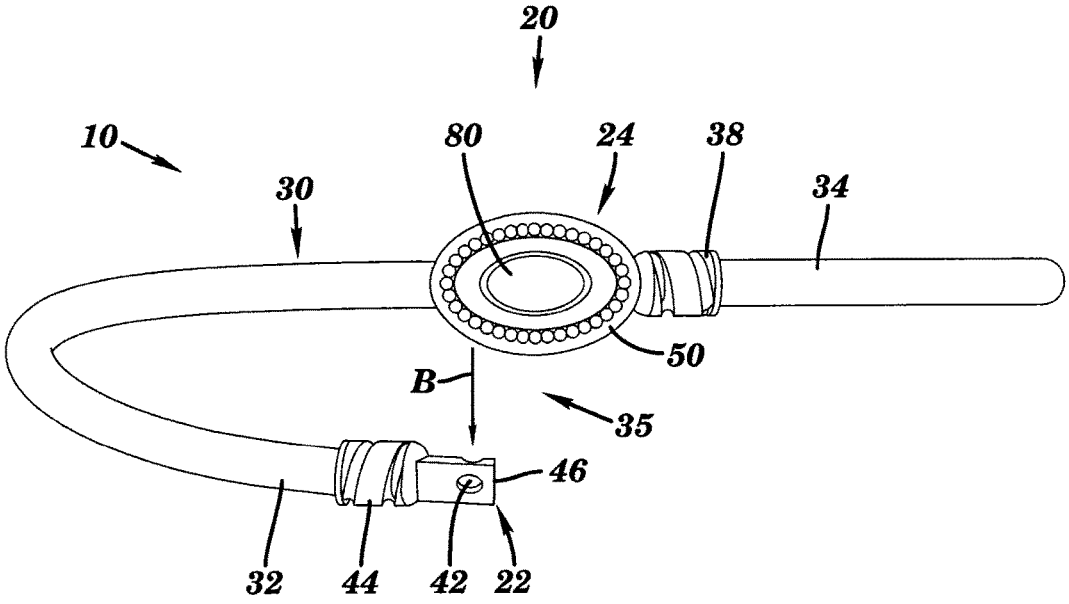
FIG. 3 is a top view of the jewelry article of FIG. 1 disposed in an open position.

Bracelet 10, as shown in FIGS. 2 and 3, is illustrated in an open position for example prior to being placed on a wrist of a person or prior to removal from a wrist of a person. Clasp 20 may include a male clasp portion 22 and a female clasp portion 24. Male clasp portion 22 may comprise a tongue 40 having an opening 42 and a distal end 46. Female clasp portion 24 may generally include a generally hollow housing 50 and a movable button 80.

In one aspect of the present disclosure, with reference again to FIG. 1, upon a user applying a force downwardly or pressing movable button 80 in the direction of arrow A, male clasp portion 22 is disconnectable or releasable from female clasp portion 24 and moved in a direction B (FIGS. 2 and 3) with male clasp portion 22 spaced away from female clasp portion 24 as shown in FIGS. 2 and 3, and so that end portions 32 and 34 may be disposed out of alignment or spaced apart from each other to define a gap 35 between end portions 32 and 34.

In another aspect of the present disclosure, elongated member 30 may be a generally rigid spring-like elongated member that aids a user in opening and closing the clasp. For example, when male clasp portion 22 is disconnected from female clasp portion 24, male clasp portion 22 may spring away from and be spaced apart from female clasp portion 24 as shown in FIGS. 2 and 3. Such a springing action may allow a user with one hand to easily disconnect male clasp portion 22 from female clasp portion 24 and remove bracelet 10 from one's wrist.

Figure 4:
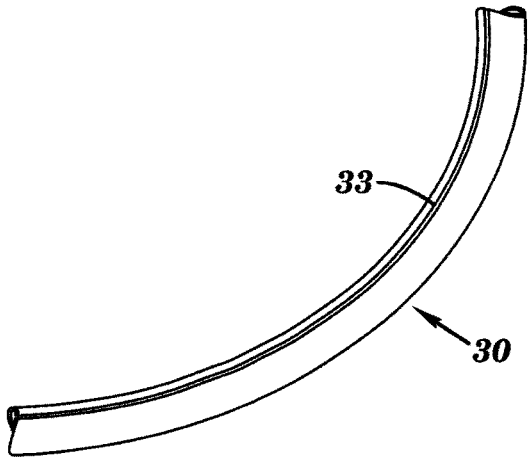
FIG. 4 is an enlarged perspective view of a portion of the elongated member of the jewelry article shown in FIG. 1.
Figure 5:
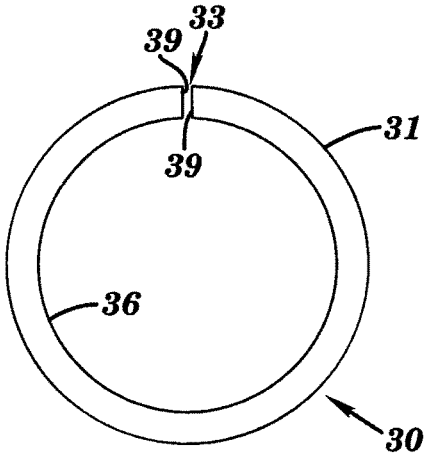
FIG. 5 is an enlarged cross-sectional view of the elongated member of the jewelry article shown in FIG. 1 having a seam in accordance with aspects of the present disclosure.

As shown in FIGS. 4 and 5, elongated member 30 may have a hollow round tubular configuration. For example, in one embodiment, elongated member 30 may be a hollow tube with a seam 33 formed by juxtaposed edges 39 (FIG. 5) along the longitudinal length of the tube. Seam 33 may extend from the outer surface 31 (FIG. 5) to an inner surface 36 of the tube and extend along the length of the elongated member from a terminal or collar 38 (FIGS. 2 and 3) to a terminal or collar 44 (FIGS. 2 and 3). The seam may be disposed along an inner radial portion of elongated member. It will be appreciated that other cross-sectional configurations of the elongated member may be suitably employed. In some embodiments, for example as shown in FIG. 1, the overall shape of the elongated member from one collar to the other collar may be generally in the form of an oval loop. In some embodiments, the overall shape of the elongated member from one collar to the other collar may be generally in the form of a circular loop. It will be appreciated that the bracelet or bangle having have other elongated members that have other shaped loops.

With reference again to FIGS. 2 and 5, elongated member 30 may be a generally rigid spring-like elongated member. For example, elongated member 30 may be formed from an elongated planar member or flat planar strip, which is formed into a tube having a seam, and then formed into a coil or helix configuration. The elongated hollow tube may be formed or arbored into shape using an arbor mandrel, or by winding around a shaped former such as a cylindrical or oval shaped tool. The shaped elongated member having a seam may be heat treated or hardened to be normally configured or unstressed in the open position shown in FIGS. 2 and 3. As described below, the elongated member may have a design or textured pattern. For example, the elongated planar member or flat planar strip may be cut from a larger planar sheet having a design or textured pattern. A tool or press may operably form the design or textured pattern on the planar sheet.

Such a configuration allows the male clasp portion to move and remain away from the female clasp portion of the clasp in the open position. For example, edges 39 (FIG. 5) may move relative to each other and enable the elongated member to flex in a generally torque-like motion or twist when the bracelet moves between the clasp's closed position to the open position. Similarly, a user may move the male clasp portion into engagement with the female clasp portion resulting in edges 39 (FIG. 5) moving relative to each other and enable the elongated member to flex in a generally torque-like motion or twist when the bracelet moves between the clasp's open position to the closed position. As appreciated from the present disclosure, the heat treatment, seamed construction, and shaping parameters transform the elongated member into an effective working spring. Because the bracelet itself may be a spring, the tongue releases and the bracelet opens when the push button is pressed. When the clasp is closed the elongated member or bracelet bangle is tensed, when the clasp is open the bracelet flings open to its normal "at rest" position.

In some embodiments, the body of the female clasp portion may have a length of about 11 mm, a width of about 9 mm, and a height of about 8 mm. The length of the elongated member may be about 18 cm to about 20 cm, and about 19 cm long. An oval shape of the elongated member may include a long axis of about 7 cm, and a short axis of about 5.2 cm. The tube may have an outside diameter of about 3 mm. The wall thickness of the tube maybe about 0.018 inches. The elongated member may be formed from a generally hard or hardenable material. Examples of suitable material may be sterling silver, gold such as 18K or lower, brass, spring steel, stainless steel, palladium, platinum, etc. It will be appreciated that the elongated member may be a solid elongated member such as formed from a wire.

Figure 6:
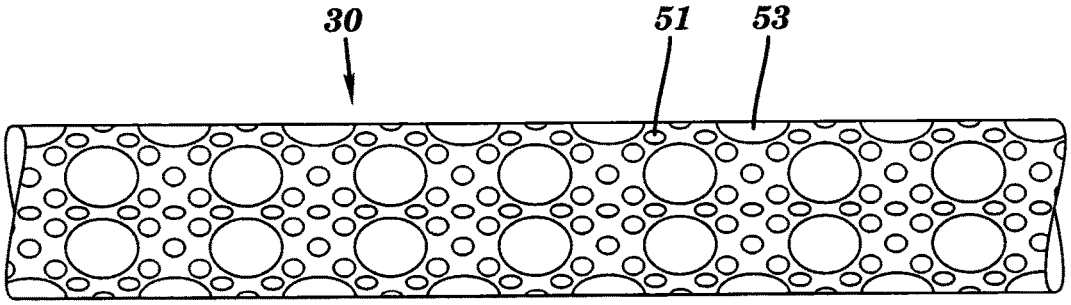
FIG. 6 is an enlarged portion of an elongated member illustrating a patterned surface in accordance with aspects of the present disclosure.

The outer surface of the elongated member may be smooth, or have a textures or patterned surface. For example, an elongated member may have a patterned surface, such as shown in FIG. 6, having a plurality of raised portions such a plurality of raised small circles 51 and a plurality of raised large circles 53. A textured or patterned surface may extend around and along the length of the elongated member. A patterned surface may be formed by a pattern tool/pattern die.

Figure 7:
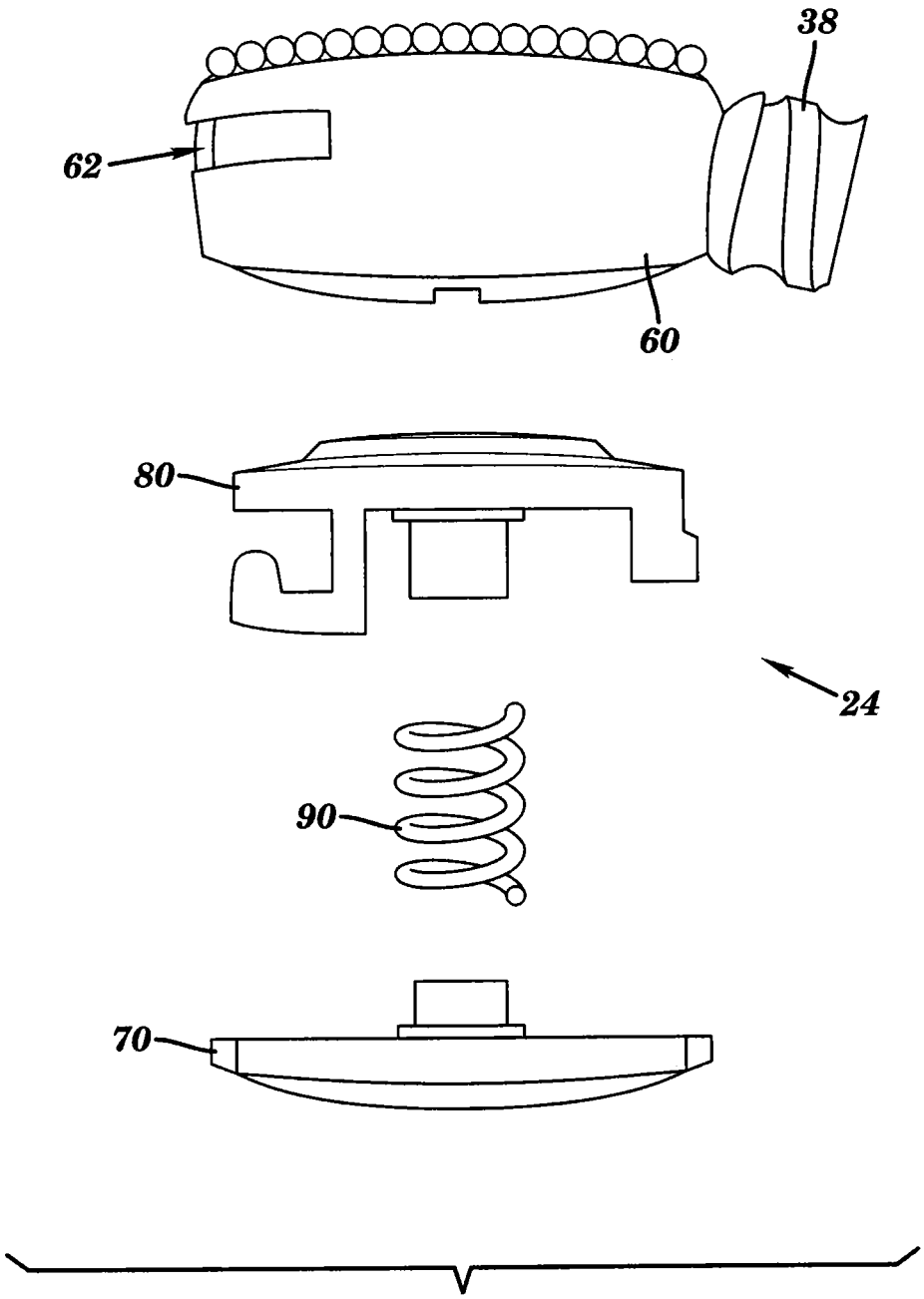
FIG. 7 is an enlarged, exploded elevational view of the female clasp portion of the jewelry article of FIG. 1.

With reference to FIG. 7, female clasp portion 24 may include a housing formed from a generally hollow body portion 60 and a base 70, movable button 80, and a biasing member 90. Generally the housing is attachable to second end portion of the elongated member via collar 38. For example, collar 38 may be a portion of body 60 such as cast as one or a single piece. Biasing member 90 may be a coil spring or a compression spring.

Figure 8:
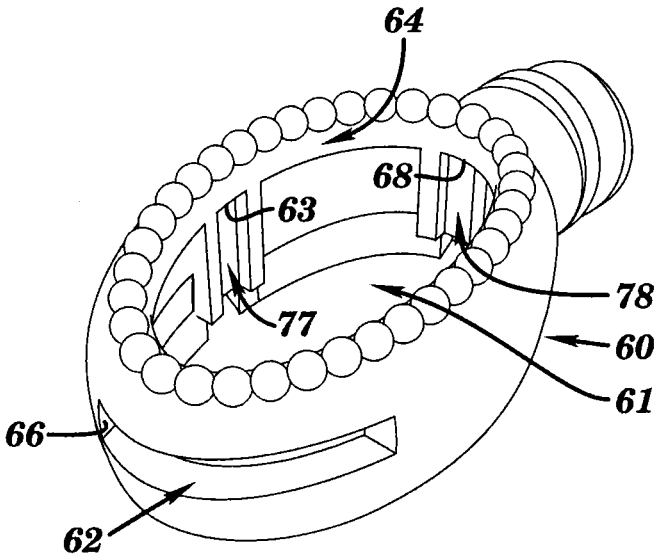
FIG. 8 is an enlarged perspective view of the hollow body portion of the female clasp portion of FIG. 7.
Figure 9:
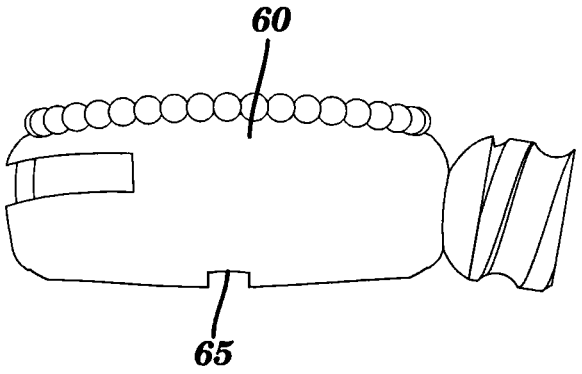
FIG. 9 is a side elevational view of the hollow body portion of the female clasp portion of FIG. 8.
Figure 10:
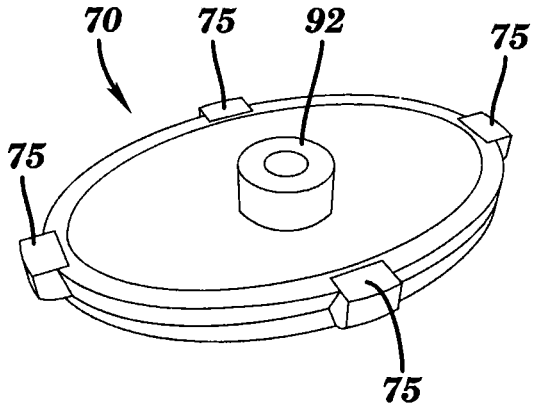
FIG. 10 is an enlarged perspective view of a base portion of the female clasp portion of FIG. 1.

As shown in FIG. 8, generally hollow body 60 includes a cavity 61, a first opening 62 or elongated slot that extends from an outer surface of the generally hollow body to the cavity for releasably receiving the tongue, and a second opening 64. With reference to FIGS. 9 and 10, base 70 (FIG. 10) may include one or more tabs 75 engageable with stops 65 (FIG. 9) of generally hollow body 60 (FIG. 9), respectively, for attaching base 70 to hollow body 60. Base 70 (FIG. 10) may include a cylindrical post or pad 92 receivable in and for positioning the biasing member such as a coil spring in the housing.

For example, tabs 75 may be laser welded or soldered to hollow body 60. The tabs or male keys of the base fit into corresponding female notches in the hollow body. The keys and notches allow for orientation of the body and base, as well as the biasing member or spring as described below. The four tabs also provide points of contact for soldering or welding the clasp housing shut.

Figure 11:
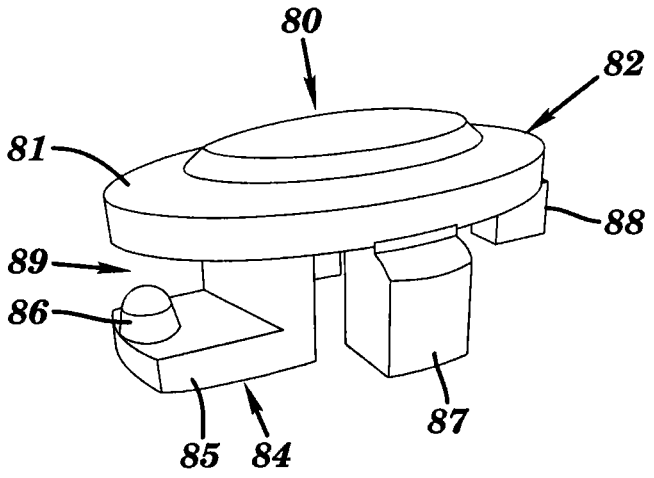
FIG. 11 is a enlarged perspective view of the movable button of the female clasp portion of FIG. 1.

With reference to FIG. 11, movable button 80 is sized and configured to be receivable in cavity 61 (FIG. 8) of hollow portion 60 (FIG. 8), and includes a first portion 82 positionable in second opening 64 (FIG. 8) of generally hollow portion 60. First portion 82 includes an upper surface 81. Movable button 80 includes a second portion 84 defining an upwardly-extending post 86. A gap 89 is defined between the top of post 86 and a bottom of first portion 82. Movable button 80 may also include two side guides 87 (FIG. 12) and an end guide 88. Movable button 80 may also include a small cylindrical pad 83 (FIG. 14) centered in the movable button for receiving and restrain a top portion of the biasing member or coil.

Figure 12:
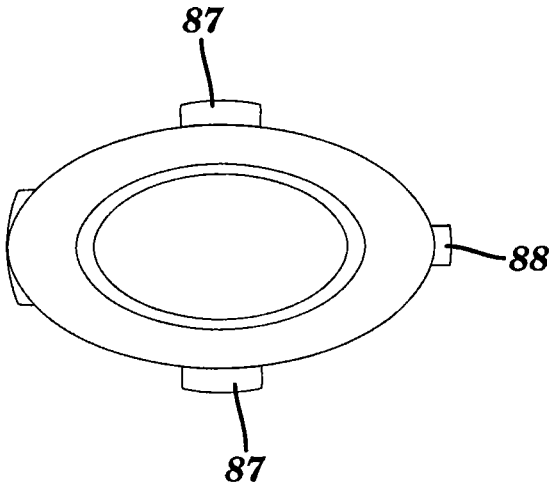
FIG. 12 is a top view of the movable button of FIG. 11.

With reference again to FIG. 8, two side channels 77 (only one shown in FIG. 8) and an end channel 78 may be disposed along the inside or interior of hollow portion 60 to slideably receive guides 87 and 88 of movable button 80, as shown in FIGS. 11 and 12, to restrain and limit slideable motion between the movable button and the hollow body portion. For example, as shown in FIG. 8, pairs of rails may define the channels. Alternately, the body may have a generally constant thickness with channels formed therein. Guides 87 and channels 77 may be wider than guide 88 and channel 78. The guides and channels stabilize the push button in the housing. As will be appreciated, the guides and channels aid in preventing the push button from tilting or pivoting when activated to compress and released the biasing member. In addition, top surfaces of guides 87 and 88 of movable button 80, shown in FIGS. 11 and 12, may be restrained from upward motion by a lower, inwardly-extending surfaces 63 and 68, respectively. The top surfaces of the guides may be contoured and nest into the lower surfaces of the clasp housing preventing the movable button from protruding too far or tilting due to the constant upwards pressure from the biasing member.

Figure 13:
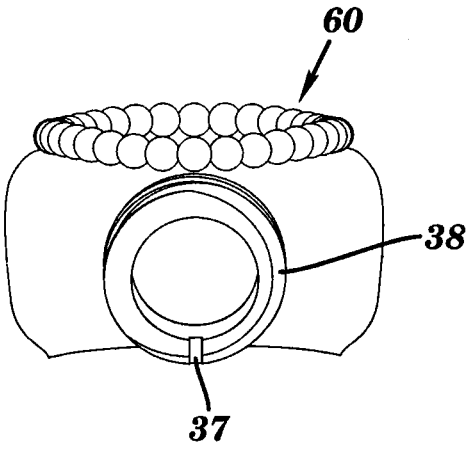
FIG. 13 is a side elevational view of the hollow body portion of female clasp portion of FIG. 8.

As shown in FIG. 13, decorative terminal or collar 38 of body 60 enables capping the open end of the elongated member. The end portion of the elongated member fits inside a cavity in collar 38 and may also hide a solder seam securing the two components together. A notch 37 may be provided to aid an assembler in aligning the clasp housing relative to the seam on the elongated member. With reference to FIG. 1, decorative terminal or collar 44 may have a cavity that enables capping the other open end of the elongated member. A notch (not shown in FIG. 1) in collar 44 may be provided to aid an assembler in aligning the clasp housing relative to the seam on the elongated member so that the various parts align correctly. The two components may be readily assembled and soldered together. In other embodiments, an end portion of the elongated member may formed into the tongue having an opening so that the male clasp portion is integral with the elongated member.

Figure 14:
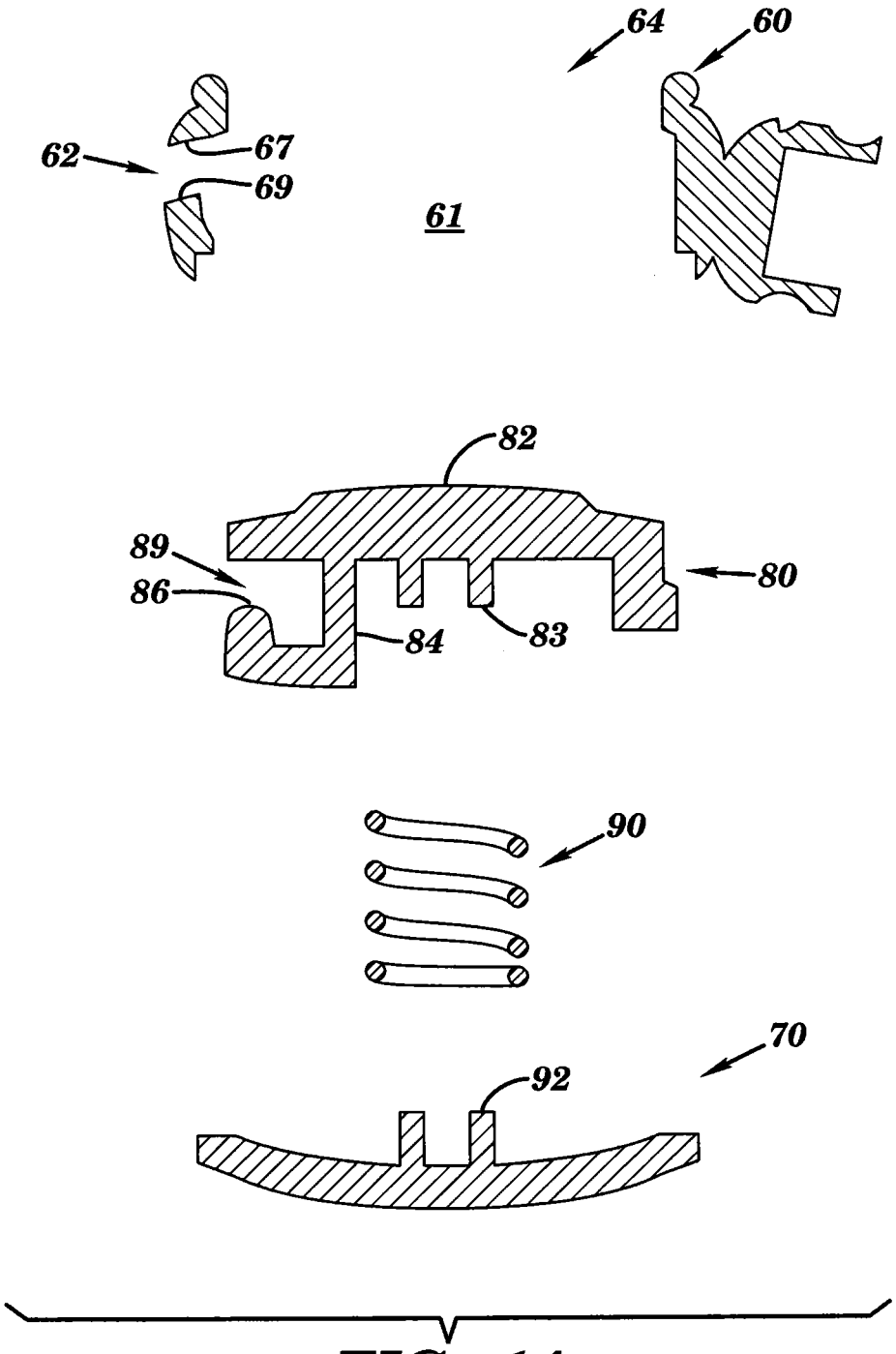
FIG. 14 is an enlarged, exploded cross-sectional view of the female clasp portion of the jewelry article of FIG. 1.
Figure 15:
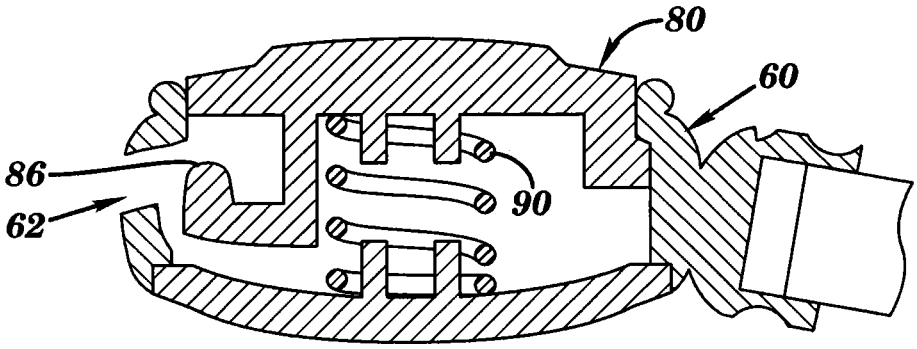
FIG. 15 is an enlarged, cross-sectional view of the female clasp portion of the jewelry article of FIG. 1 with the movable button disposed in a normal upward biased position.

As shown in FIG. 14, biasing member 90 may be disposed between movable button 80 and base 70. For example, female clasp portion may be assembled by inserting movable button 80 into a lower opening of body 60, and onto cavity 61. Thereafter, biasing member 90 such as a coil or compression spring may be inserted in cavity 61 with the top end portion of the spring disposed around cylindrical pad 83 of movable button 80. Cylindrical pad 92 of base 70 may be operably received in the lower end portion of the spring, and base 70 may operably compress spring 90 upon contacting and securing base 70 to body 60.

Figure 16:
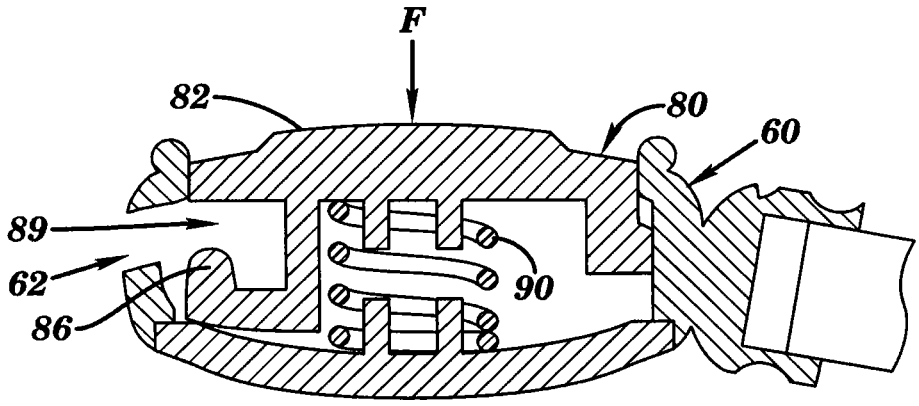
FIG. 16 is an enlarged, cross-sectional view of the female clasp portion of the jewelry article of FIG. 1 with the movable button pressed downwardly.
Figure 17:
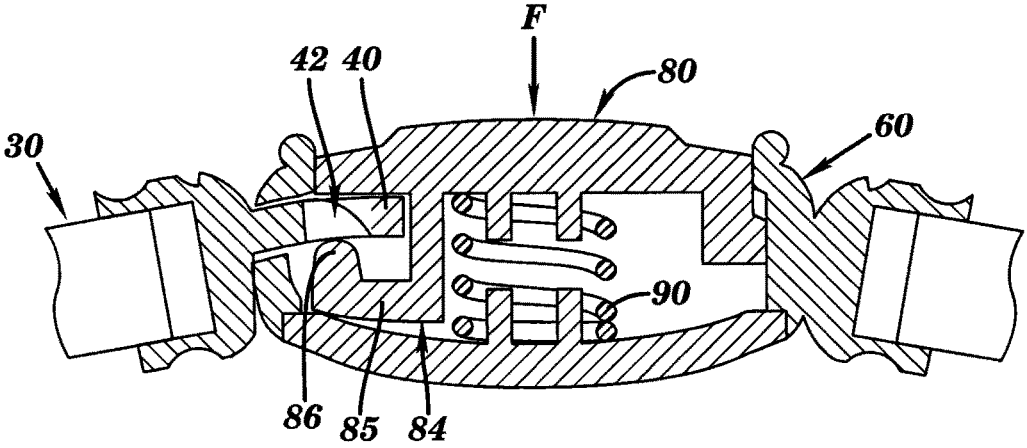
FIG. 17 is an enlarged, cross-sectional view of the jewelry clasp of FIG. 1 with the movable button of the clasp portion of the jewelry clasp pressed downwardly and the tongue of the male clasp portion of the jewelry clasp inserted in the elongated opening.
Figure 18:
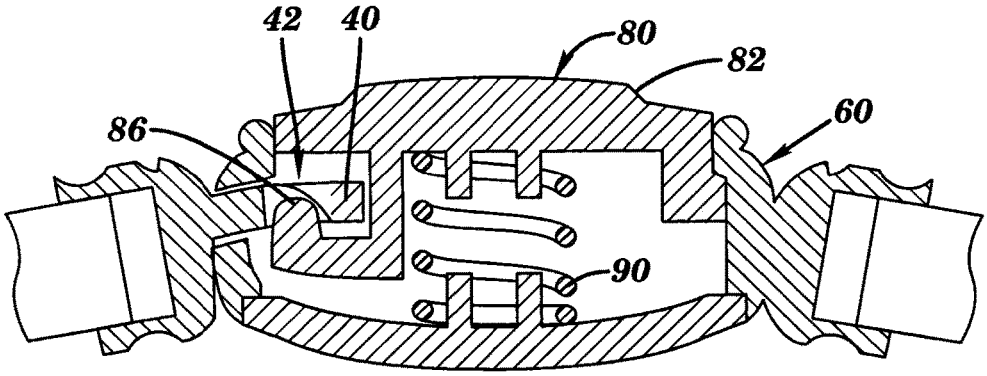
FIG. 18 is an enlarged, cross-sectional view of the jewelry clasp of FIG. 1 with the movable button of the female clasp portion of the jewelry clasp disposed in its normal upward biased position retaining the tongue of the male clasp portion of the jewelry clasp secured to the female clasp portion of the jewelry clasp.

With reference to FIGS. 15-18, biasing member 90 such as a coil spring or a compression spring may be operable to bias movable button 80 towards a normally biased first position (FIGS. 15 and 18) in which post 86 is disposable adjacent to first opening 62 (FIGS. 15 and 16) in generally hollow portion 60 with either the male clasp portion disconnected from the female clasp portion (FIG. 15) or in with post 86 disposed in opening 42 (FIG. 18) in tongue 40 (FIG. 18). Biasing member 90, for example, compression or coil spring is operably compressed upon activation by a user applying a force F (FIGS. 16 and 17) on first portion 82 of movable button 80 so that movable button is moved to a second position in which gap 89 is aligned with first opening 62 (FIG. 16), and so that tongue 40 (FIG. 17) may be moved between first opening 62 (FIG. 16) and gap 89 (FIG. 16). A lower portion 85 (FIG. 17) of second portion 84 of movable button 80 may be shaped to nest into the contour of the clasp housing providing a stable footing for the mechanism when the user presses the button compressing the spring. To disconnect male clasp portion from female clasp portions, a user applies a force to button 80, for example, as shown in FIG. 17, so that first opening 62 (FIG. 16) and gap 89 (FIG. 16) are generally aligned and allow tongue 40 to be moved and/or biased away from first opening 62 as shown in FIGS. 2 and 3.

With reference again FIG. 18, movable button 80 is illustrated in a normally biased locking position with the male and female clasp portions connected together. A user may apply a force F (FIG. 17) to movable button 80 to move movable button 80 to a release position, illustrated in FIG. 17, so that tongue 40 may be moved away from first opening 62 of hollow portion 60 as shown in FIG. 16. As described above, upon applying a force to the connected male and female clasp portions as shown in FIG. 17, the biasing effect or springing action of the elongated member results in male clasp portion automatically moving or being automatically biased or sprung away from first opening 62 (FIG. 16) without the action by the user. For example, the tongue may move away from and to the side of body 60 such as moved away from upper and lower sides 67 and 69 (FIG. 14) of the first opening 62 of body 60. A user may flex, if necessary, the elongated member to move the end portions of the elongated member to provide a greater distance between the male and female clasp portions when removing and installing the bracelet to one's wrist.

Figure 19:
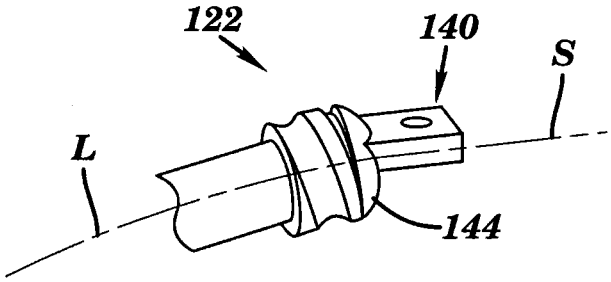
FIG. 19 is an enlarged side elevational view of the male clasp portion of the jewelry article of FIG. 1.
Figure 20:
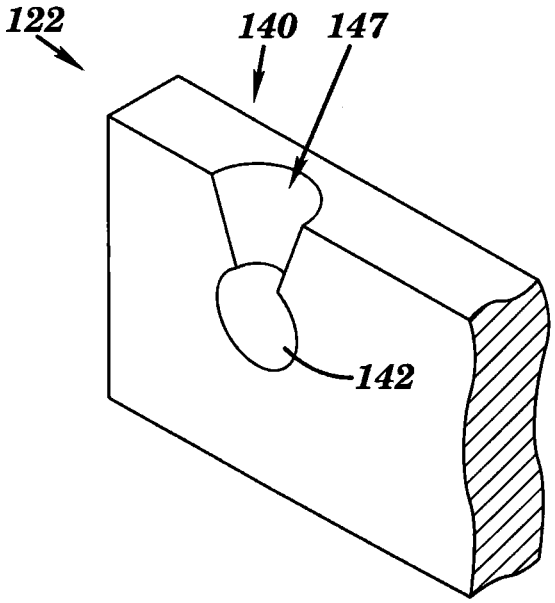
FIG. 20 is an enlarged, bottom perspective view of the male clasp portion of the jewelry article of FIG. 1.

In another aspect of the present disclosure, the male clasp portion may be readily and easily connected to the female clasp portion in accordance with aspects of the present disclosure. With reference to FIGS. 19 and 20, a male clasp portion 122 may include a tongue 140 having a generally planar configuration with a cutout 147 (FIG. 20) extending from one side of the tongue to opening 142 (FIG. 20). The cutout may be a tapering cutout, such as tapering across the depth of the tongue, having a larger cutout portion along the side of the tongue and a smaller cutout portion opening onto opening 142. A collar 144 (FIG. 19) may be a portion of tongue 140. As shown in FIG. 11, the upper portions of post 84 may be rounded.

When a user places the bracelet on one's wrist, the user may readily connect the male clasp portion to the female clasp portion using one hand and without the need to press the movable button. For example, with the bracelet placed on one's wrist in the open position, a user may move the male clasp portion into engagement with the female clasp portion such as applying a force between the user's thumb engaging the male clasp portion and the user's pointer finger engaging the female clasp portion. The larger portion of cutout 147 will initially engage a side portion of the upper rounded surface of post 86. As the user continues to apply force and move the male clasp portion into engagement with the female clasp portion, the tapered cutout will force post 86 downwardly as the smaller cutout portion is moved above the post. Once the post is aligned with opening 142, the post will automatically move, snap, and/ or lock into opening 142 (e.g., as shown in FIG. 18) without force F (FIG. 17) being applied.

With reference again to FIG. 1, first opening 62 of body 60 may include an elongated slot disposed asymmetrically relative to female clasp portion 24 and longitudinal axis L of the closed loop. Elongated slot 62 may be defined by upper and lower surfaces that are angled relative to curving longitudinal axis L. For example as shown in FIG. 19, tongue 140 may include flat upper and lower surfaces defining a straight longitudinal axis S that are angled relative to longitudinal axis L. In other embodiments, the elongated slot and the tongue may define longitudinal axes that are aligned, e.g., have the same curved configurations to allow the tongue to be moved from the side into the elongated slot. For example, the tongue may be movable in a direction perpendicular relative to the closed longitudinal axis of the loop when moved into and out of the elongated slot. In addition, a portion of the body may define a side wall or stop 66 (FIG. 8) for aligning the tongue with the longitudinal axis of the closed loop.

Figure 21:
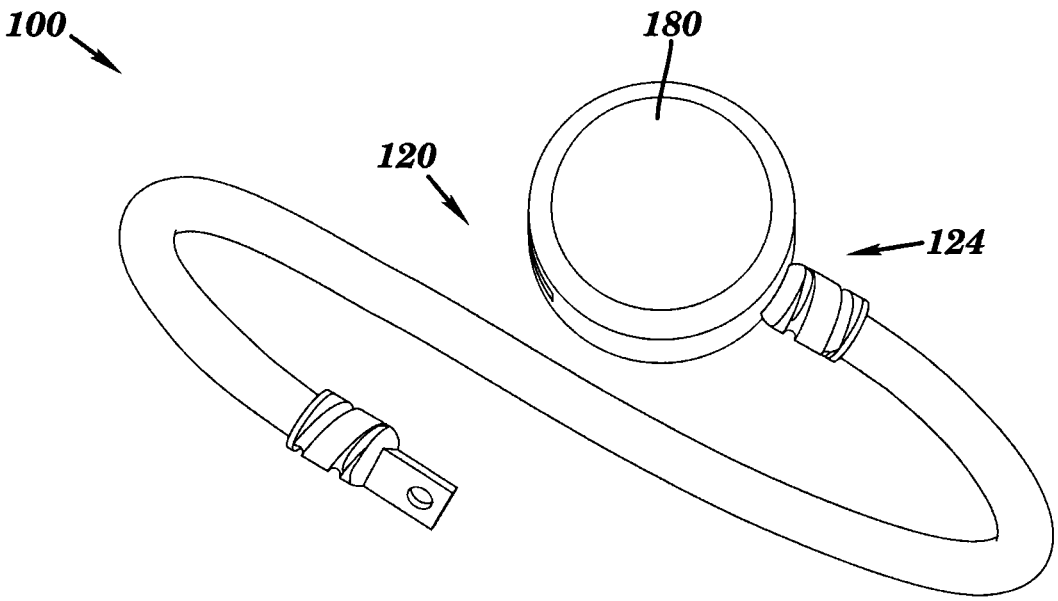
FIG. 21 is a perspective view of another embodiment of a jewelry article in accordance with aspects of the present disclosure.

FIG. 21 illustrates another embodiment of a jewelry article 100 such as a bracelet in accordance with aspects of the present disclosure which may incorporate the various aspects described in connection with bracelet 10 (FIG. 1). For example, in this embodiment, bracelet 100 may include a jewelry clasp 120 having a female clasp portion 124 having a generally rounded or cylindrical body shape, and movable button 180 may have a generally convex outer surface.

Figure 22:
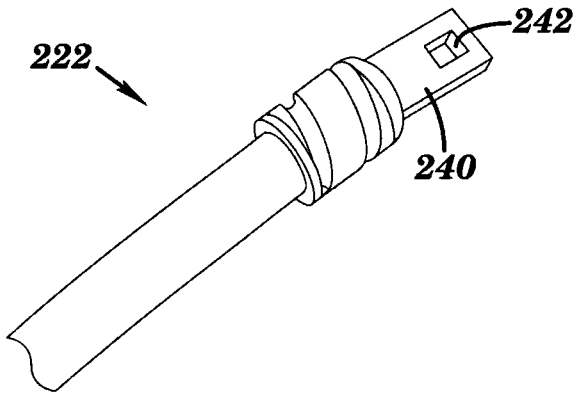
FIG. 22 is a top perspective view of another embodiment of a male clasp portion of a jewelry clasp having a square opening in accordance with aspects of the present disclosure.
Figure 23:
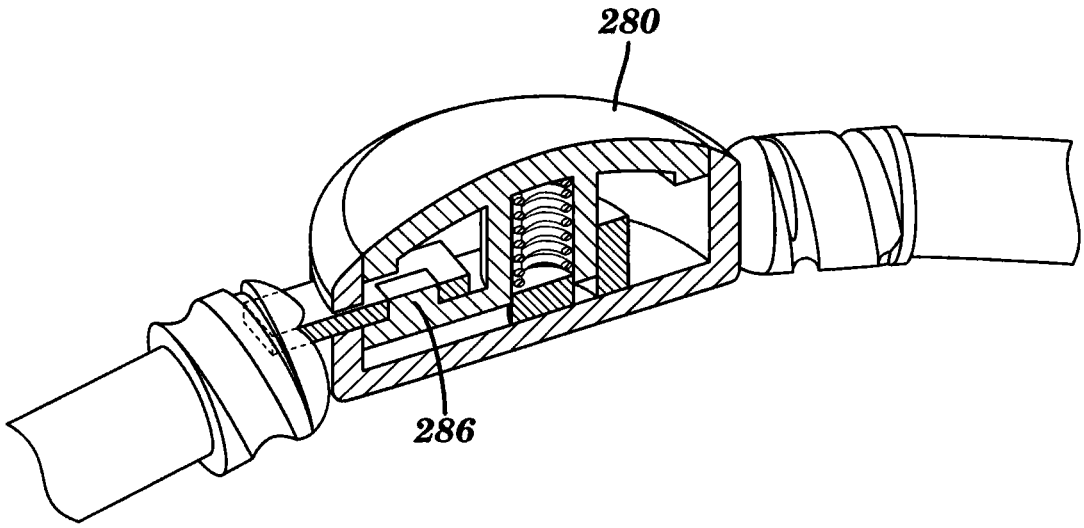
FIG. 23 is a perspective, partially cutaway, view of another embodiment of a jewelry article in which a tongue of a male clasp portion of the jewelry clasp has a square opening and the female clasp portion of the jewelry clasp has a post having a square cross-section.

FIG. 22 illustrates another embodiment of a male clasp portion 222 in accordance with the aspects of the present disclosure in which a tongue 240 may include a square opening 242. A movable button 280, as shown in FIG. 23, may include a post 286 having a square shaped configuration for engaging the square shaped hole of the tongue.

Figure 24:
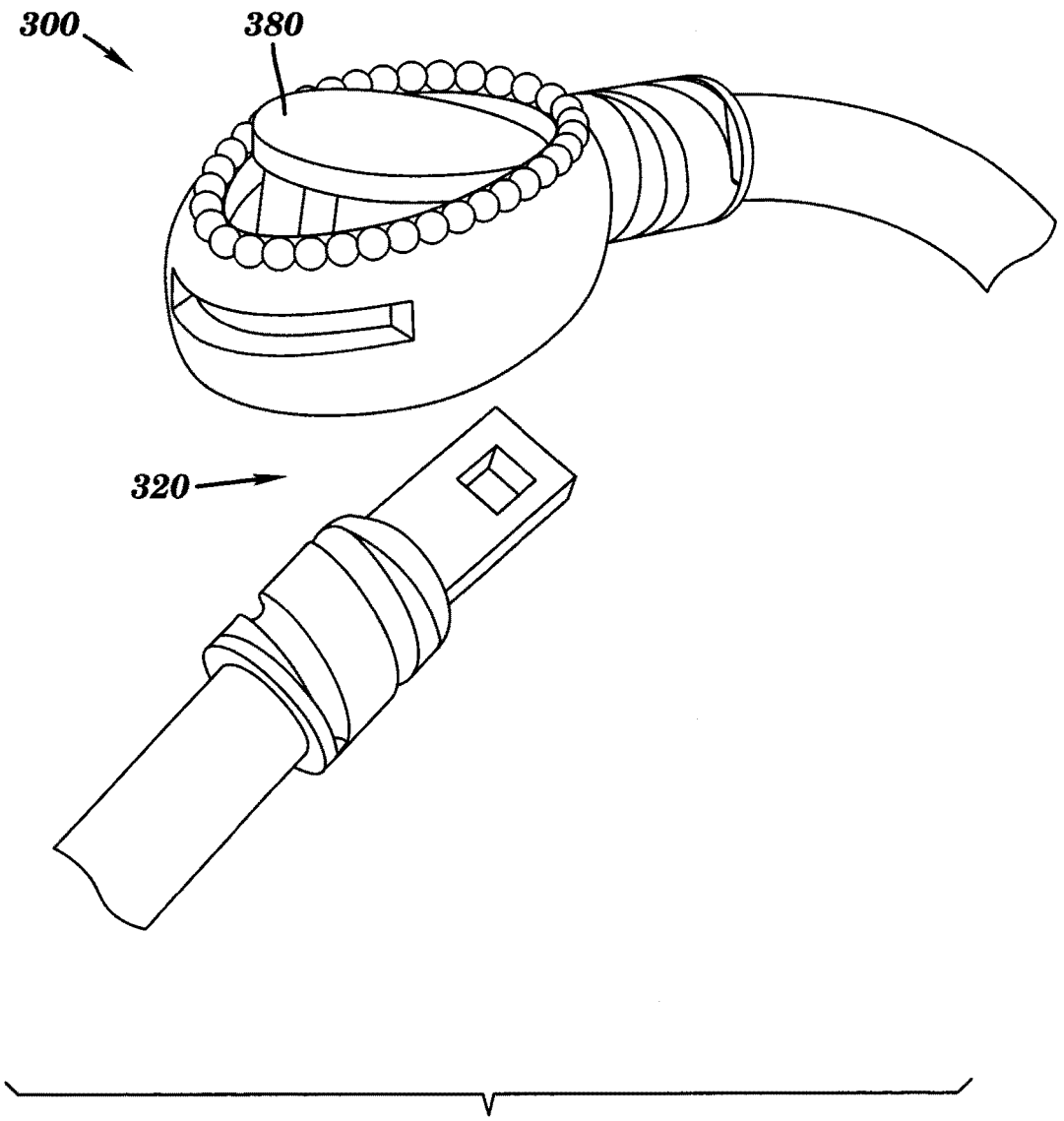
FIG. 24 is a top perspective view of another embodiment of a jewelry article having jewelry clasp having a pivotable button in accordance with aspects of the present disclosure.
Figure 25:
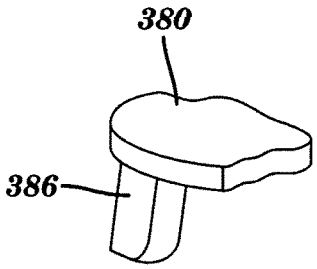
FIG. 25 is a perspective view of a portion of the pivotable button of FIG. 24.
Figure 26:
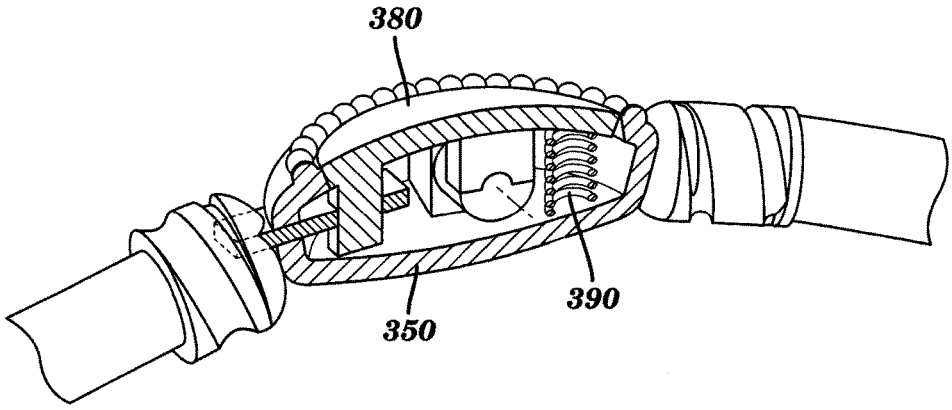
FIG. 26 is a perspective, partially cutaway, view of the jewelry clasp of FIG. 24.

FIGS. 24-26 illustrate another embodiment of a jewelry article 300 such as a bracelet in accordance with aspects of the present disclosure which may incorporate the various aspects described in connection with bracelet 10 (FIG. 1). In this embodiment, bracelet 300 may include a jewelry clasp 320 having a generally hollow housing 350 having a generally oval body shape, and a movable button 380 which is pivotable between a first position for connecting the clasp portions together and a second position where the clasp portions are disconnectable. A post 386 (FIG. 25) may be operably movable or forced by a user upwardly and biased in a downward direction. A biasing member 390 such as a compression or coil spring may be employed to operably bias movable button 380.

In the various embodiments, it will be appreciated that other biasing members may be employed in the female clasp portion. For example, the biasing member may be one or more leaf springs, one or more torsion springs, one or more spiral springs, other biasing members that may employed to have a biased position and movable to a second position.

Figure 27:
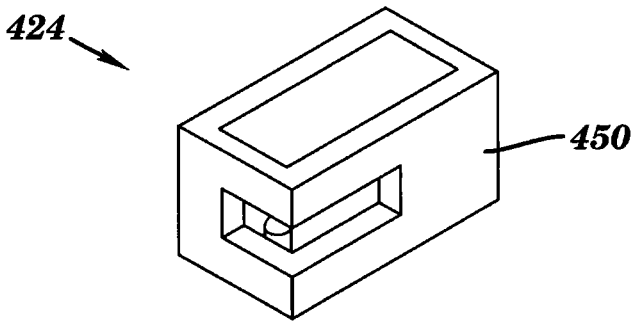
FIGS. 27-29 are perspective views of embodiments of the female clasp portions in accordance with aspects of the present disclosure.
Figure 28:
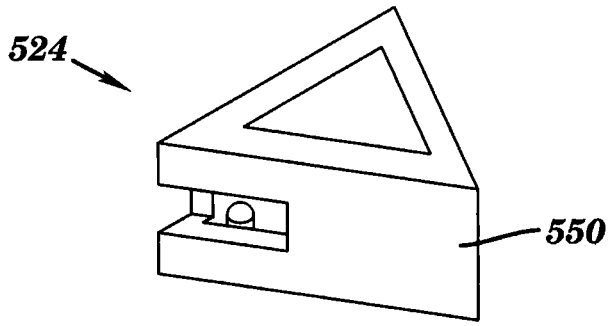
Figure 29:
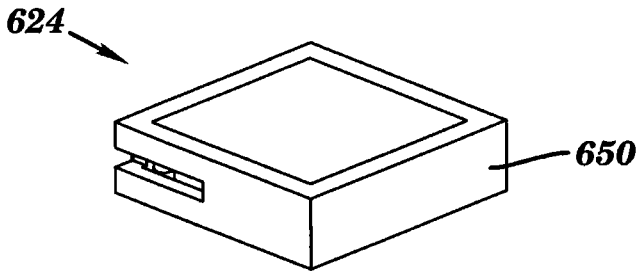

In the various embodiments, it will be appreciated that the female clasp portion may have other shapes for the housing incorporating the above described and illustrated aspects and features of the present disclosure. For example, as shown in FIG. 27, a female clasp portion 424 may have a rectangular or cube shaped housing 450, as shown in FIG. 28, a female clasp portion 524 may have a triangular shaped housing 550, and as shown in FIG. 29, a female clasp portion 624 may have a diamond shaped housing 650. It will be appreciated that the other housing shapes having an elongated opening or slot may be suitably employed. While the tongue is described and illustrated as having a generally rectangular planar shape, it will be appreciated that other configuration may be employed. For example, the tongue may have rounded or curved corners or other configurations. The opening may or may not extend all the way through the tongue. Other configurations of the tongue may be employed that operably attach to the movable post of the push button. In addition, instead of a coil or compression spring, the biasing member may be one or more leaf springs, one or more torsion springs, one or more spiral springs, or other biasing members that may be employed to have a biased position and being movable to a second position.

With reference again to FIG. 1, the female clasp portions may be generally oval with an oval raised beading 91, and a generally oval raised land 93. The elongated member may have a generally oval shape. The decorative terminals or collars may include outer non-functional threads. In other embodiments, the decorative terminals or collars may smooth. The various configurations provide visual balance to the design by matching the threaded look of the other terminal.

Figure 30:
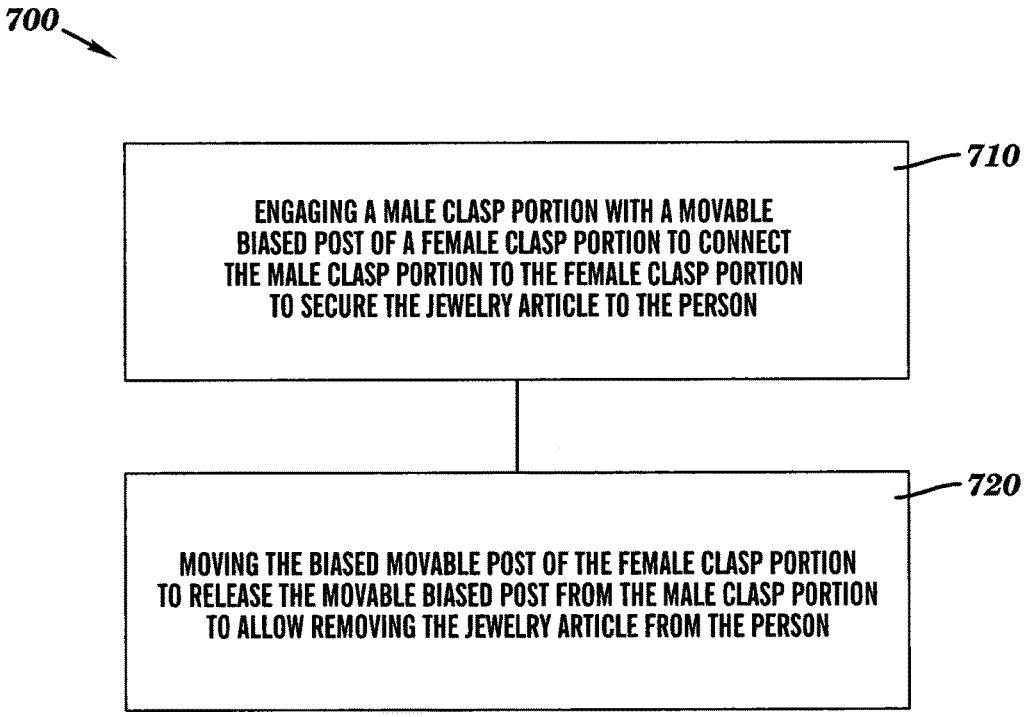
FIG. 30 is a flowchart of a method for securing and removing a jewelry article from a person in accordance with aspects of the present disclosure.

With reference to FIG. 30, a method 700 for securing and removing a jewelry article from a person includes at 710, engaging a male clasp portion with a movable biased post of a female clasp portion to connect the male clasp portion to the female clasp portion to secure the jewelry article to the person, and at 720 moving the biased movable post of the female clasp portion to release the movable biased post from the male clasp portion to allow removing the jewelry article from the person.

It is to be understood that the above description is intended to be illustrative, and not restrictive. For example, the above-described embodiments and/or aspects thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A clasp for use with an elongated member, said clasp comprising:

a male clasp portion and a female clasp portion connectable to opposite ends of the elongated member and when said male clasp portion is connected to said female clasp portion, the elongated member, said male clasp portion, and said female clasp portion comprise a closed loop defining a longitudinal axis;

said male clasp portion comprising a tongue having an opening;

said female clasp portion comprising:

a generally hollow body comprising a first opening and a second opening, said first opening comprising an elongated slot disposed asymmetrically relative the longitudinal axis of the closed loop for receiving said tongue in a first direction perpendicular to the longitudinal axis, a portion of the generally hollow body defining said elongated slot defining a stop parallel to the longitudinal axis for aligning said tongue with said female clasp portion and with the longitudinal axis of the closed loop and preventing movement of said tongue in the first direction perpendicular to the longitudinal axis;

a movable button disposed in said body, said movable button having a first portion positioned in said second opening of said generally hollow body and a second portion defining a post;

a biasing member disposed between said movable button and said body; and wherein said biasing member is operable to bias said movable button in a locking position in which said post is disposable through at least a portion of said opening in said tongue when said tongue is disposed in said elongated slot against said stop of said generally hollow body and said tongue is lockingly engaged with said post, and said movable button is operable to being moved to a release position in which said post is disengagable from said opening in said tongue to allow said tongue to move relative to a side of said female clasp portion and to the longitudinal axis in a second direction perpendicular to the longitudinal axis and opposite from said first direction out of said elongated slot and spaced away from said generally hollow body.

2. The clasp of claim 1 wherein said tongue comprises a cutout for progressively biasingly engaging an upper surface of said post when said tongue is moved to said locking position.

3. The clasp of claim 2 wherein said cutout comprises a tapering cutout.

4. The clasp of claim 1 wherein said movable button comprises guides slideably receivable in channels in said body to guide movement between said locking position and said release position.

5. The clasp of claim 1 wherein said opening in said tongue extends through said tongue.

6. The clasp of claim 5 wherein said opening in said tongue comprises a round opening.

7. The clasp of claim 1 wherein said post comprises a rounded end engageable with said tongue.

8. The clasp of claim 1 wherein said movable button is pivotally movable around a pivot axis in said generally hollow body between said locking position and said release position.

9. The clasp of claim 1 wherein said biasing member comprises a spring.

10. The clasp of claim 1 wherein said biasing member comprises a coil spring.

11. A releasable fastening method comprising:

connecting the male clasp portion to the female clasp portion of the clasp of claim 1; and applying a force to the moveable button of the female clasp portion to disconnect the male clasp portion from the female clasp portion.

12. The method of claim 11 further comprising automatically moving the first male clasp portion from the female clasp portion upon applying the force to the moveable button.

13. A jewelry article comprising:

an elongated member having a first end portion and a second end portion;

a male clasp portion attached to the first end portion of the elongated member, said male clasp portion comprising a tongue having an opening;

a female clasp portion comprising:

a generally hollow body attached to said second end portion of the elongated member, said generally hollow body having a first opening and a second opening;

a movable button disposed in said body, said movable button having a first portion positioned in said second opening of said generally hollow body and a second portion defining a post;

a biasing member disposed between said movable button and said body;

said male clasp portion and said female clasp being connectable so that said elongated member, said male clasp portion, and said female clasp portion comprise a closed loop defining a longitudinal axis;

said first opening of said female clasp portion disposed asymmetrically relative to said longitudinal axis of the closed loop for receiving said tongue in a first direction perpendicular to the longitudinal axis, a portion of the generally hollow body defining said first opening defining a stop parallel to said longitudinal axis for aligning said tongue with said longitudinal axis of said closed loop and said stop preventing movement of said tongue in said first direction perpendicular to said longitudinal axis;

wherein said biasing member is operable to bias said movable button in a locking position in which said post is disposable through at least a portion of said opening in said tongue when said tongue is disposed in said first opening against said stop of said generally hollow body and said tongue is lockingly engaged with said post, and said movable button is operable to being moved to a release position in which said post is disengagable from said opening in said tongue to allow said tongue to move relative to a side of said female clasp portion and to said longitudinal axis in a second direction perpendicular to said longitudinal axis and opposite from said first direction out of said first opening and be spaced away from said generally hollow body; and wherein said elongated member is configured so that when said male clasp portion is disconnected from said female clasp portion, said first end portion of said elongated member and said male clasp portion springs away from and moves perpendicularly to said longitudinal axis in said second direction and said tongue of said male clasp portion moves out of said first opening of said female clasp portion.

14. The jewelry article of claim 13 wherein said elongated member comprises a hollow member with a longitudinally extending seam.

15. The jewelry article of claim 14 wherein said hollow member is heat treated.

16. The clasp of claim 13 wherein said tongue comprises upper and lower surfaces angled relative to said longitudinal axis.

17. The clasp of claim 13 wherein said movable button is movable radially relative to said longitudinal axis of a closed loop between said locking position and said release position.

18. A method for wearing a jewelry article, the method comprising:

connecting the male clasp portion to the female clasp portion of the jewelry article of claim 13 with the elongated member disposed around a wrist of a person; and applying a force to the moveable button to disconnect the male clasp portion from the female clasp portion.

19. The method of claim 18 further comprising automatically moving the first male clasp portion from the female clasp portion upon applying the force to the moveable button.

* * * * *